US005348221A

United States Patent [19]

Grecksch et al.

[11] Patent Number: 5,348,221

[45] Date of Patent: Sep. 20, 1994

[54] TEXTILE MACHINE APPARATUS FOR HANDLING TUBES HAVING REMAINING YARN

[75] Inventors: Hans Grecksch; Ulrich Wirtz, both of Monchengladbach; Helmut Kohlen, Erkelenz; Paul Surkamp, Kempen; Helmuth Hensen, Monchengladbach, all of Fed. Rep. of Germany

[73] Assignee: W. Schlafhorst & Co., Moenchengladbach, Fed. Rep. of Germany

[21] Appl. No.: 539,008

[22] Filed: Jun. 15, 1990

[30] Foreign Application Priority Data

Jun. 15, 1989 [DE] Fed. Rep. of Germany ..... 3919527
Mar. 23, 1990 [DE] Fed. Rep. of Germany ..... 4009318

[51] Int. Cl.[5] ..... B65H 67/06; D01H 9/18
[52] U.S. Cl. ..... 242/35.5 A; 57/281
[58] Field of Search ..... 57/281, 90, 264; 242/35.5 A; 209/525, 552, 927

[56] References Cited

U.S. PATENT DOCUMENTS 3,195,298 7/1965 Furst ..... 57/281 X
3,606,012 9/1971 Brouwer ..... 209/585
3,608,293 9/1969 Brouwer ..... 57/281
3,913,743 10/1975 Nelson ..... 209/601 X
4,181,228 1/1980 Hashimoto et al. ..... 57/281 X
4,508,227 4/1985 Kupper ..... 209/927
4,544,107 10/1985 Matsui et al. ..... 242/35.5 A
4,545,551 10/1985 Uchida et al. ..... 242/35.5 A
4,586,668 5/1986 Mori ..... 28/292
4,605,177 8/1986 Uchida et al. ..... 242/35.5 A

FOREIGN PATENT DOCUMENTS 0059168 4/1983 Japan ..... 242/35.5 A

*Primary Examiner*—Daniel P. Stodola
*Attorney, Agent, or Firm*—Shefte, Pinckney & Sawyer

[57] ABSTRACT

A textile machine apparatus for handling tubes having remaining yarn thereon includes a branch path for supporting tube support members, which individually support tubes thereon, for travel to and from the discharge assembly of a textile winding machine. The tube handling apparatus also includes a sensor disposed along the discharge transport path of the tube support members from the winding stations of the textile winding machine for discriminating among tubes having no yarn thereon and tubes having remaining yarn thereon. A guide member is operatively connected to the discriminating sensor for guiding the tube support members supporting tubes having remaining yarn thereon onto the branch path for transport therealong to a tube stripping device, which strips the tubes of the remaining yarn. The stripped tubes are then returned to the discharge transport path at a location upstream of the discriminating sensor. In one aspect of the invention, the discriminating sensor discriminates among tubes having less than a predetermined minimum amount of yarn thereon, tubes having more than a predetermined minimum amount of yarn thereon, and tubes having no yarn thereon.

17 Claims, 2 Drawing Sheets

TEXTILE MACHINE APPARATUS FOR HANDLING TUBES HAVING REMAINING YARN

BACKGROUND OF THE INVENTION

The present invention relates to a textile machine apparatus for handling tubes having remaining yarn thereon.

In known textile machine arrangements in which a spinning machine is operatively connected with a winding machine, tubes having yarn built thereon to form a yarn package are supplied from the spinning machine to the winding machine for unwinding of the yarn packages by the winding machine and empty tubes having no yarn thereon are supplied from the winding machine to the spinning machine for subsequent yarn package building operations. It is also known to provide a transport system for transporting the tubes around the spinning and winding machines which includes a plurality of peg tray-type tube support members for individually supporting the tubes in upright dispositions.

Those tubes which are circulated from the winding machine to the spinning machine must be free of yarn before they are resupplied to the individual spinning stations of the spinning machine. In normal operation, a relatively high number of the tubes exiting the winding stations are ideally already free of any remaining yarn due to the successful complete unwinding of the yarn package previously supported on the tube. However, the operational reality of the yarn winding operation is that a certain percentage of the tubes exiting the winding station will still have remaining yarn thereon. Of those tubes having remaining yarn thereon, it is helpful to distinguish between tubes having more than a predetermined minimum amount of yarn which would make it worthwhile to recirculate the tube to a winding station for further unwinding of the remaining yarn and those tubes which have less than the predetermined minimum amount which are more advantageously handled by stripping the remaining yarn therefrom to place them in condition as empty tubes.

U.S. Pat. No. 4,544,107 discloses an arrangement in which tubes having yarn remaining thereon after passing through the winding stations are collected for manual handling of the tubes to strip the remaining yarn therefrom or to prepare the end of the yarn for re-processing through a winding station. However, the collection of the tubes detrimentally reduces the number of tubes which are available for circulation between the winding machine and the associated spinning machine and creates the risk that the production capacity of the spinning and winding machines must be curtailed due to an insufficient number of tubes available for the spinning and winding operations. Accordingly, the need exists for an assembly for handling tubes having remaining yarn thereon in a manner which does not significantly reduce the number of tubes available for the building of yarn packages thereon.

SUMMARY OF THE INVENTION

The present invention provides an apparatus for handling tubes with remaining yarn thereon, the apparatus having a branch path for selectively guiding the tubes from a winding station discharge path to a tube stripping device, a special yarn end preparation device or a storage location so that the number of tubes which remain out of the operational circulation path of tubes between a textile winding machine and an associated spinning machine is minimized and the cumulative amount of time which the out of circulation tubes remain out of the operational circulation path is also minimized.

Briefly described, the present invention provides an apparatus for a textile winding machine of the type having a plurality of winding stations at which yarn is unwound from yarn packages, a delivery assembly for transporting tube support members on which yarn packages are individually supported for transport to the winding stations, and a discharge assembly for transporting tube support members with tubes supported thereon from the winding stations. The apparatus handles tubes received by the discharge assembly from the winding stations with yarn remaining thereon and includes branch path means defining a branch path for supporting tube support members for travel therealong having an entrance end operatively connected to the discharge assembly for the passage of tube support members from the discharge assembly to the branch path and an exit end operatively connected to the discharge assembly for the passage of tube support members from the branch path to the discharge assembly at a location upstream from the entrance end relative to the direction of transport of tube support members by the discharge assembly.

The assembly also includes a tube stripping device disposed along the branch path for performing a yarn stripping operation on those tubes having remaining yarn thereon which are supported on the tube support members on the branch path. Additionally, the assembly includes discriminating means disposed along the discharge assembly for discriminating among tubes supported on tube support members being transported by the discharge assembly past a discriminating location upstream of the entrance end of the branch path, the discriminating means being operable to discriminate between empty tubes having no yarn thereon and tubes having remaining yarn thereon. The apparatus further includes guiding means, operatively connected to the discriminating means, for guiding those tube support members supporting tubes having remaining yarn thereon from the discharge assembly to the branch path at the entrance end thereof in response to the identification of the tube support members by the discriminating means.

According to one aspect of the present invention, the apparatus also includes post-stripping sensing means disposed relative to the tube stripping device for sensing the presence of yarn on a tube after the tube has been subjected to a yarn stripping operation by the tube stripping device and means defining a storage location extending from the branch path at a location thereon downstream of the tube stripping device. Moreover, in this one aspect of the present invention, the apparatus further includes storage guiding means, operatively connected to the post-stripping yarn sensing means, for guiding from the branch path to the storage location those respective tube support members supporting tubes having yarn remaining thereon following yarn stripping operations in response to sensing by the post-stripping sensing means of the respective tubes.

According to a different aspect of the present invention, the apparatus additionally includes secondary discriminating means disposed along the branch path upstream of the tube stripping device for discriminating among the tubes supported on those tube support members which have been guided onto the branch path and the secondary discriminating means being operable to discriminate between tubes having more than a predetermined minimum recirculating amount of yarn thereon and tubes having less than the predetermined minimum recirculating amount of yarn thereon. In this different aspect, the apparatus further includes re-feed path means extending from the branch path downstream of the secondary discriminating means for transporting tube support members from the branch path to the delivery assembly for recirculation to the winding stations, and tube stripper guiding means operatively connected to the secondary discriminating means and disposed along the branch path downstream of the secondary discriminating means and upstream of the tube stripping device. The tube stripper guiding means guides tube support members supporting tubes having less than the predetermined minimum recirculating amount of yarn thereon to the tube stripping means in response to sensing of the tubes by the secondary discriminating means and allows tube support members supporting tubes having more than the predetermined minimum recirculating amount of yarn to pass to the re-feed path means.

According to yet another aspect of the present invention, the discriminating means is operable to discriminate among empty tubes having no yarn thereon, tubes having less than a predetermined minimum recirculating amount of yarn thereon and tubes having more than the predetermined minimum recirculating amount of yarn thereon. Also, re-feed path means is provided extending from the branch path for transporting tube support members from the branch path to the delivery assembly for recirculation to the winding stations. The assembly also includes tube stripper guiding means, operatively connected to the discriminating means and disposed along the branch path upstream of the tube stripping device. The tube stripper guiding means guides tube support members supporting tubes having less than the predetermined minimum recirculating amount of yarn thereon to the tube stripping means in response to sensing by the discriminating means and allows tube support members supporting tubes having more than the predetermined minimum recirculating amount of yarn to pass to the re-feed path means.

The apparatus of yet another aspect of the present invention also includes time delay means, operatively connected to the discriminating means and the tube stripper guiding means, for delaying the guiding operation of the tube stripper guiding means by a predetermined amount of delay time following the identification by the discriminating means of a tube having less than the predetermined recirculating amount of yarn. The predetermined amount of delay time corresponds to the amount of travel time required for the travel of the tube support member supporting the respective discriminated tube from the location at which the respective tube is identified by the discriminating means to the location for guiding of the tube support member by the tube stripper guiding means to the tube stripper.

According to other features of the yet another aspect of the present invention, there is provided means downstream of the tube stripping device for sensing tubes that have not been satisfactorily stripped of yarn by the tube stripping device and means defining a storage location extending from the branch path downstream of the tube stripping sensing means. Also, there is provided storage guiding means for guiding from the branch path to the storage location the tube support members that support tubes sensed by the tube stripper sensing means that have not been satisfactorily stripped of yarn by the tube stripping device.

According to an additional aspect of the present invention, the apparatus also includes tube stripper guiding means, operatively connected to the discriminating means and disposed along the branch path upstream of the tube stripping device, for guiding tube support members supporting tubes having less than the predetermined minimum recirculating amount of yarn thereon to the tube stripping means in response to sensing of the tubes by the discriminating means and allowing tube support members supporting tubes having more than the predetermined minimum recirculating amount of yarn to pass to the re-feed path means. Also, the apparatus includes means defining a storage location extending from the branch path downstream of the tube stripping device and storage guiding means for guiding from the branch path to the storage location the tube support members that support tubes sensed by the tube stripper sensing means that have not been satisfactorily stripped of yarn by the tube stripping device.

The apparatus of the additional aspect of the present invention also includes entry sensing means for sensing the presence of a tube support member an entry sensing location on the discharge assembly upstream of the exit end of the branch path and downstream of the winding stations, re-entry sensing means for sensing the presence of a tube support member at a re-entry location along the branch path downstream of the storage guiding means and upstream of the exit end, and primary sensing means for sensing the presence of a tube support member at a primary sensing location along the discharge assembly downstream of the exit end of the branch path and upstream of the entrance end of the branch path. Further features of the apparatus include a control unit operatively connected to the entry sensing means and the reentry sensing means, operatively connected to the control unit, for selectively blocking further travel of the tube support members beyond a stop location along the discharge assembly between the entry sensing location and the exit end of the branch path in response to a signal from the control unit, and stop means. The stop means is operatively connected to the primary sensing means and the control unit for selectively blocking further travel of tube support members beyond a stop location along the discharge assembly between the primary sensing location and the entrance end of the branch path in response to a signal from the control unit.

According to further features of the additional aspect of the present invention, the apparatus includes recirculating traffic sensing means, operatively connected to the control unit, for sensing the presence of a tube support member at a recirculating traffic sensing location along the branch path upstream of the tube stripper guiding means, and post-stripping sensing means, operatively connected to the control unit, for sensing the presence of a tube support member at a sensing location along the branch path downstream of the tube stripping device and upstream of the storage guiding means. The control unit is operable to receive signals from each of the sensing means indicating the presence of a tube support member at the location associated with the respective sensing means and to operate at least one of the stop means to selectively block further travel of tube support members beyond the respective stop location.

With regard to the further features of the additional aspect of the present invention, the control unit is operatively connected to each of the guiding means for control of operation of the guiding means in response to sensing by at least one of the sensing means. Also, the control unit operates the storage guiding means to guide tube support members from the branch path to the storage location tube support members that have been sensed by the reentry sensing means during their travel therepast. Additionally, the control unit controls the tube stripping device to permit the transport therethrough of a selected tube support member without performing a yarn stripping operation on the tube supported thereon in response to the evaluation by the control unit of signals received from the sensing means that indicate that the selected tube support member has previously passed through the tube stripping device without successful stripping of yarn from the tube supported thereon.

An additional feature of the additional aspect of the present invention include tube stripper traffic sensing means, operatively connected to the control unit, for sensing the presence of a tube support member at a location along the branch path downstream of the tube stripper guiding means and upstream of the tube stripping device. The control unit controls the tube stripper guiding means to guide each tube support member onto the delivery path in response to sensing by the tube stripper traffic sensing means of a tube support member in a substantially stationary condition at the tube stripper entry sensing location due to the presence of a sufficient number of tube support members disposed between the tube stripper entry sensing location and the tube stripping device to prevent further travel of the sensed stationary tube support member.

Another additional feature includes outlet means, operatively connected to the delivery path and the control unit, for releasing tube support members from the branch path to the delivery assembly. Furthermore, the apparatus also includes a storage traffic sensing means, operatively connected to the control unit, for sensing the presence of a tube support member at a storage sensing location downstream of the storage guiding means. In regard to these additional features, the control unit controls the storage guiding means to permit tube support members to be further transported along the branch path beyond the storage guiding means in response to the sensing by the storage traffic sensing means of a tube support member held in a substantially stationary condition at the storage sensing location due to the presence of a sufficient number of tube support members disposed at the storage location to prevent further receipt of tube support members at the storage location.

DETAILED DESCRIPTION OF THE PREFERRED EMBODIMENTS

Figure 1:
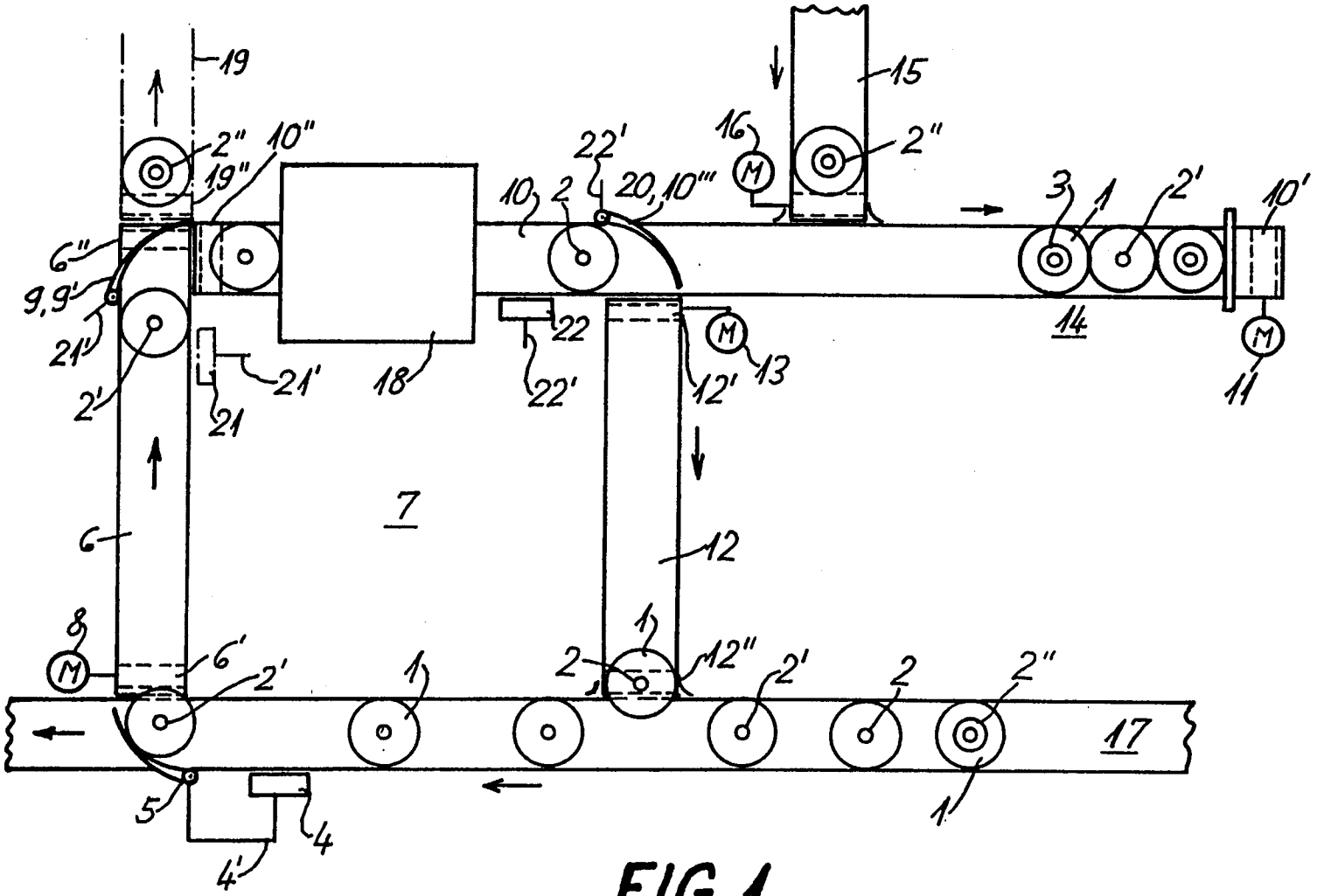
FIG. 1 is a plan view of a portion of the discharge assembly of a textile winding machine for transporting tubes from the winding stations of the winding machine to a location for further handling and showing one embodiment of the tube handling apparatus of the present invention operatively installed on the textile winding machine.

In FIG. 1, one embodiment of the tube handling apparatus 7 of the present invention is illustrated. A conventional textile winding machine, of which only a portion of its discharge assembly is shown, is operatively connected to a conventional textile spinning machine (not shown) for circulation of full yarn packages from the spinning machine to the winding machine and of empty tubes from the winding machine to the spinning machine. The textile winding machine includes a plurality of winding stations for individually unwinding yarn from yarn packages thereat, a delivery assembly for transporting yarn packages from a yarn package receiving location adjacent the textile spinning machine to the winding stations and a discharge assembly for transporting tubes from the winding stations to a location for further handling such as, for example, a location for transfer of the empty tubes to the textile spinning machine. The delivery assembly and the discharge assembly are operatively connected to one another for circulation of a plurality of peg tray-type tube support members 1 along the delivery assembly, through the winding station, along the discharge assembly and again to the delivery assembly. Each tube support member 1 is conventionally configured and is preferably of the type having an annular base portion and a vertical post member for insertion of the tube thereon for supporting the tube in an upright disposition during transport the tube by the tube support member.

The discharge assembly of the textile winding machine includes a conventional flexible endless member in the form of a discharge belt 17 which extends past a plurality of winding station exit paths along which the tube support members 1 are transported from the winding stations to the discharge assembly. The discharge belt 17 ultimately extends to the further handling location at which the tubes supported on the tube support members 1 are further handled.

The tube handling apparatus 7 of the present invention is provided to handle tubes received by the discharge assembly from the winding stations which are of the type having yarn remaining thereon. These tubes can be characterized either as a tube 2' having less than a predetermined minimum recirculating amount of yarn thereon or a tube 2'' having more than a predetermined minimum recirculating amount of yarn thereon.

Additionally, the tubes 2' and 2'' having yarn remaining thereon can be distinguished from the other types of tubes which are received by the discharge assembly from the winding stations. This third type of tube, designated as the tubes 2, comprise those tubes, commonly called empty tubes, which have substantially no yarn remaining thereon following their transport from the winding stations. The tubes 2 are placed in their condition as empty tubes through the successful complete unwinding of the yarn packages previously supported on the tubes at the winding stations.

The tubes 2'' can generally be regarded as comprising those tubes having less than a full yarn package thereon but still having a sufficient amount of yarn (i.e.—greater than the predetermined minimum recirculating amount of yarn) to justify re-circulation of the tube to a winding station for another yarn unwinding operation. For example, the tubes 2'' may have a yarn package thereon which was not completely unwound at a winding station. The tubes 2'' additionally include those tubes supporting full yarn packages 3 which had not had any yarn unwound therefrom at a winding station.

The tube handling apparatus 7 includes branch path means 6,10,12 defining a branch path for supporting the tube support members 1 for travel therealong. The branch path has an entrance end operatively connected to the discharge belt 17 for the passage of the tube support members 1 from the discharge belt 17 to the branch path and an exit end operatively connected to the discharge belt 17 for the passage of the tube support members 1 from the branch path to the discharge belt 17 at a location upstream from the entrance end of the branch path relative to the direction of transport of the tube support members by the discharge belt 17. The branch path means includes a flexible endless member in the form of an entrance belt 6 which forms the entrance end of the branch path and a flexible endless member in the form of an exit belt 12 which forms the exit end of the branch path.

The entrance belt 6 is trained around a conventional guide roller 6″ and a conventional drive roller 6′, which operatively connected to a conventional drive motor 8 for driving operation of the entrance belt 6. The exit belt 12 is trained around a conventional guide roller 12″ and a conventional drive roller 12′, which is operatively connected to a conventional drive motor 13 for driving operation of the exit belt 12. The upstream end of the entrance belt 6 is positioned adjacent the travel path of the discharge belt 17 for relatively smooth transfer of the tube support members 1 from the discharge belt onto the entrance belt 6. The downstream end of the exit belt 12 is positioned adjacent the travel path of the discharge belt 17 for relatively smooth transfer of the tube support members 1 from the exit belt 12 to the discharge belt 17. The travel paths of the entrance belt 6 and the exit belt 12 extend transversely to the travel path of the discharge belt 17 on a common lateral side thereof.

The tube handling apparatus 7 additionally includes a flexible endless member in the form of a tube stripping belt 10 trained around a conventional guide roller 10″ and a conventional drive roller 10′, which is operatively connected to a conventional drive motor 11 for driving operation of the tube stripping belt 10. The tube stripping belt 10 extends generally transversely to the travel path of the entrance belt 6 and the exit belt 12. The upstream end of the tube stripping belt 10 is positioned relatively adjacent the upstream end of the entrance belt 6 for relatively smooth transfer of the tube support members 1 from the entrance belt 6 to the tube stripping belt 10. The tube stripping belt 10 extends parallel to the discharge belt 17 and is offset therefrom to the same respective lateral side of the discharge belt as the entrance belt 6 and the exit belt 12.

The exit belt 12 is dimensioned such that the extent of its travel path generally corresponds to the spacing between the tube stripping belt 10 and the discharge belt 17 so that the upstream end of the exit belt 12 is positioned relatively closely adjacent the travel path of the tube stripping belt 10 at a location downstream from the upstream end of the tube stripping belt 10 for relatively smooth transfer of the tube support members 1 from the tube stripping belt 10 to the exit belt 12. The travel path of the tube stripping belt 10 extends beyond its junction with the exit belt 12 to form a storage location 14 for the storage of tube support members 1 thereat.

A conventional tube stripping device 18 is disposed along the branch path at a location along the tube stripping belt 10 intermediate the junction between the entrance belt 6 and the tube stripping belt 10 and the junction between the exit belt 12 and the tube stripping belt 10. The tube stripping device 18 is operable to perform yarn stripping operations on tubes supported on the tube support members 1 delivered thereto along the branch path.

The tube handling apparatus 7 also includes a discriminating means in the form of a yarn presence sensor 4 disposed along the travel path of the discharge belt 17 intermediate the junction of the discharge belt 17 with the entrance end of the branch path and the junction of the discharge belt 17 with the exit end of the branch path. The yarn presence sensor 4 is operable to discriminate among tubes supported on tube support members 1 being transported by the discharge belt 17 past a discriminating location. The yarn presence sensor 4 is operable to discriminate between two types of tubes—empty tubes 2 having no yarn thereon and tubes having remaining yarn thereon (e.g., the tubes 2′, 2″ and the yarn packages 3).

The tube handling apparatus 7 additionally includes a guiding means in the form of a positionable curved arm member 5 for guiding selected tube support members 1 from the discharge belt 17 to the branch path at the entrance end thereof in response to the identification of the selected tube support members by the yarn presence sensor 4. In this regard, the movable arm member 5 is operatively connected via a connector 4′ to the yarn presence sensor 4 for receiving signals therefrom. The movable arm member 5 is movable in response to an identification by the yarn presence sensor 4 of a tube having remaining yarn thereon (e.g., a tube 2′, 2″ or a yarn package 3) from a non-guiding position out of interference with the travel path of the discharge belt 17 to a guiding position at an angle across the travel path of the discharge belt 17 for guiding of the tube support member 1 supporting the identified tube from the discharge belt 17 onto the entrance belt 6.

A re-feed path means is provided for transporting the tube support members 1 along a re-feed path from the branch path to the delivery assembly or to a conventional yarn end preparation device for preparing the end of yarn on a tube supported on the tube support members 1. The re-feed path can be formed, for example, by a conventional flexible endless member or belt 19 trained around a conventional guide roller 19″ and a conventional drive roller (not shown). The upstream end of the belt 19 is positioned relatively closely adjacent the downstream end of the entrance belt 6 and the travel paths of the two belts are aligned for effecting relatively smooth transfer of the tube support members 1 from the downstream end of the entrance belt 6 onto the belt 19 at its upstream end. The conventional yarn end preparation device for preparing the yarn ends of the tubes transported along the belt 19 can be, for example, a yarn end preparation device specially configured to thoroughly engage the yarn to ensure that a yarn end is loosened therefrom. Alternatively, the conventional yarn end preparation device can be the same yarn end preparation device which prepares the yarn ends of the incoming yarn packages 3 being transported by the delivery assembly of the winding machine from the yarn package receiving location to the winding stations. In this regard, the downstream end of the belt 19 can be positioned adjacent the travel path of the delivery assembly of the winding machine for re-introducing the tube support members 1 to the delivery assembly for further yarn unwinding operations.

A secondary discriminating means in the form of a conventional yarn amount sensor 21 is disposed along the travel path of the entrance belt 6 for discriminating among the tubes supported on those tube support members 1 which have been guided onto the branch path. In contrast to the yarn presence sensor 4, which simply discriminates between tubes having no yarn and tubes having yarn, the yarn amount sensor 21 is operable to discriminate between the tubes 2' having more than the predetermined minimum recirculating amount of yarn thereon and the tubes 2'' having less than the predetermined minimum recirculating amount of yarn. A tube stripper guiding means in the form of a movable curved arm member 9 is disposed along the travel path of the entrance belt 6 downstream of the yarn amount sensor 21 and relative to the junction between the entrance belt 6 and the tube stripping belt 10 for selectively guiding the tube support members 1 from the entrance belt 6 to the tube stripping belt 10. The movable arm member 9 is operatively connected via a connector 21' to the yarn amount sensor 21 and is operable in response to a signal received from the yarn amount sensor 21 indicating a tube 2'' having less than the predetermined minimum recirculating amount of yarn to guide the respective tube support member supporting the tube 2' from the entrance belt 6 to the tube stripping belt 10. In this regard, the movable arm member 9 moves from a clearance position out of interference with the travel path of the entrance belt 6 a position at an angle across the travel path of the entrance belt 6 for guiding the respective tube support members 1 laterally with respect to the travel path of the entrance belt 6 onto the upstream end of the tube stripping belt 10. The movable arm 9 remains in its clearance position in response to the sensing by the yarn amount sensor 21 of a tube 2'' having more than the predetermined minimum amount of yarn thereon to permit the respective tube support member 1 to travel beyond the entrance belt 6 onto the belt 19.

A tube stripper sensing means in the form of a conventional yarn presence sensor 22 is positioned along the travel path of the tube stripping belt 10 downstream of the tube stripping device 18 for sensing the presence of yarn on a tube which has exited the tube stripping device 18 following a yarn stripping operation. A storage guiding means in the form of a movable curved arm member 20 is operable to guide selected ones of the tube support members 1 from the tube stripping belt 10 to the exit belt 12. In this regard, the movable arm member 20 is operatively connected via a connector 22' to the yarn presence sensor 22 and is movable from a clearance position out of interference with the travel path of the tube stripping belt 10 to a diverting position at an angle across the travel path of the tube stripping belt 10 for guiding the tube support members 1 from the tube stripping belt 10 onto the exit belt 12.

A storage feed means includes an extension of the tube stripping belt 10 beyond the exit belt 12 for receipt and retention thereon against a cross stop bar tube support members that have not been diverted by the movable arm member 20, which are the tube support members supporting tubes that have not been successfully stripped of yarn by the tube stripping means 18. A conventional flexible endless member or belt 15 defines a storage feed path from the conventional yarn end preparation device (not shown) associated with the aforementioned yarn end preparation belt 19 to the storage location 14 for the transport of tube support members 1 from the yarn end preparation device to the storage location. The feed belt 15 is trained around a conventional guide roller (not shown) and a conventional drive roller, which is operatively connected to a conventional drive motor 16 for driving operation of the belt. The downstream end of the feed belt 15 is positioned relatively closely adjacent the storage extensions of the tube stripping belt 10 to effect relatively smooth transfer of tube support members 1 from the feed belt 15 to the tube stripping belt 10 at a location downstream of the junction of the tube stripping belt 10 and the exit belt 12.

The operation of the embodiment of the tube handling apparatus 7 shown in FIG. 1 is as follows. The delivery assembly of the winding machine continuously delivers tube support members 1 supporting full yarn packages 3 from a yarn package receiving location along a transport path to the winding stations for unwinding of yarn therefrom. In a successful yarn unwinding operation, the yarn of a yarn package 3 is completely unwound from the tube so that the tube exits the respective winding station in the condition as an empty tube having no remaining yarn thereon. On the other hand, if the unwinding of the yarn is interrupted by, for example, a yarn break, or for some other reason the yarn of the yarn package is not completely unwound or is not unwound at all, for example, if the yarn end had not been properly prepared and was therefore not engaged in the winding station, the tube exits the respective winding station with yarn remaining on the tube (i.e., as an incompletely unwound yarn package or as a fully unwound package). These types of tubes are either the tubes 2' having less than the predetermined minimum recirculating amount of yarn or the tubes 2'' having more than the predetermined minimum recirculating amount of yarn. All of the tube support members 1 exiting the winding stations are commonly fed to the discharge belt 17 for transport thereby so that the tube support members 1 supporting the various types of tubes 2, 2' and 2'' are randomly fed to the discharge belt 17. Each tube supported on one of the tube support members 1 traveling on the discharge belt 17 is eventually sensed by the yarn presence sensor 4. If the yarn presence sensor 4 senses that the respective tube has yarn remaining thereon (e.g., a tube 2' or a tube 2''), the movable arm member 5 operates in response to the sensing of the tube to guide the respective tube support member 1 supporting the sensed tube from the discharge belt 17 onto the entrance belt 6. On the other hand, if the yarn presence sensor 4 senses that a tube does not have any remaining yarn thereon (e.g., a tube 2), the movable arm member 5 is operated to remain in its out of interference position to permit the respective tube support member 1 supporting the sensed tube to travel therepast in further travel toward the tube handling location at the downstream end of the discharge belt 17. The tube handling location could include, for example, a conventional empty tube transfer device for transferring the empty tubes 2 from the tube support members 1 to a plurality of tube support members on the spinning machine.

The tubes 2',2'' that have been diverted to and are transported along the entrance belt 6 are individually sensed by the yarn amount sensor 21, which senses whether the amount of yarn on the sensed tube is greater than a predetermined minimum recirculating amount of yarn. The predetermined minimum recirculating amount of yarn is the minimum amount of yarn which must be available on a tube to make it worthwhile to subject the yarn to a repeat of the unwinding operation at the winding stations. If the yarn amount sensor 21 senses that the amount yarn on the sensed tube is more than the predetermined minimum recirculating amount of yarn (e.g., a tube 2''), the movable arm member 9 is operated to remain in its clearance position to permit passage therepast of the respective tube support member 1 supporting the sensed tube. The respective tube support member 1 travels beyond the entrance belt 6 onto the belt 19 for delivery thereby directly to the delivery assembly for recirculation to the yarn end positioning means or to another yarn end preparation device associated with the belt 19 for preparation of a yarn end of the yarn on the tube 2'' and ultimate circulation to the delivery assembly. The storage feed belt 15 is operable to transport the tube support members 1 supporting those tubes 2'' which did not have their yarn ends successfully disposed in preferred preliminary dispositions for winding engagement by the yarn end preparation device associated with the belt 19 or with the delivery assembly. These unsuccessfully prepared tubes 2'' are transported by the storage feed belt 15 to the storage location 14 for convenient storage thereat until an operator can manually handle the tubes.

On the other hand, if the yarn amount sensor 21 senses that the amount of yarn on a sensed tube is less than the predetermined minimum recirculating amount of yarn (e.g., the tube is a tube 2'), the movable arm member 9 operates in response to this sensing to move to its guiding position across the travel path of the entrance belt 6 for guiding of the respective tube support member supporting the sensed tube onto the tube stripping device 10. The tube stripping belt 10' transports the respective tube support member 1 to a tube stripping location in the tube stripping device 18 for stripping of the respective tube 2'. The tube stripping device can include, for example, conventional means for mechanically stripping or cutting the yarn remaining on the tube as well as conventional forced air means for directing streams of air against the tube to displace cut yarn therefrom.

Following a yarn stripping operation, the respective tube support member 1 is advanced by the tube stripping belt 10 downstream beyond the tube stripping device 18 whereby the respective tube is transported past the yarn presence sensor 22. The yarn presence sensor 22 senses the respective tube to determine if any yarn remains on the tube. If the yarn stripping operation has not completely stripped the respective tube of all remaining yarn, the yarn presence sensor 22 senses the still remaining yarn and the movable arm member 20 responds to the sensing by the yarn presence sensor 22 by remaining in its clearance position. Accordingly, the respective tube support member 1 is transported past the movable arm member 20 by the extension of tube stripping belt 10 to the storage location 14. The storage location 14 can include a stop bar extending transversely across the travel path of the extension of the tube stripping belt 10 adjacent its downstream end for preventing further travel of the tube support members 1 delivered thereto by the tube stripping belt 10.

If the yarn presence sensor 22 senses that a respective tube exiting the tube stripping device 18 has no yarn remaining thereon (e.g., the tube is now in the condition of an empty tube 2), the movable arm member 20 operates in response to this sensing to move from its clearance position to its diverting position across the travel path of the tube stripping belt 10 for guiding the respective tube support member 1 supporting the now-empty tube 2 from the tube stripping belt 10 onto the exit belt 12, which transports the respective tube support member 1 along its travel extent to the exit end of the branch path for transfer from the exit belt 12 onto the discharge belt 17. The respective tube support member 1 supporting the now-empty tube 2 is thereafter transported by the discharge belt 17 past the yarn presence sensor 4, which controls the movable arm member 5 to remain in its clearance position to permit the tube support member to travel downstream beyond the entrance end of the branch path toward the further tube handling location.

It can thus be seen that the tube handling apparatus 7 permits only those tube support members supporting empty tubes 2 to be transported further by the discharge belt 17 to the further tube handling location, with tubes having yarn remaining thereon being further processed or, if not successfully further processed, transported to a storage location out of circulation.

In a modification of the embodiment of the tube handling apparatus 7 shown in FIG. 1, the function of the yarn presence sensor 22 can be performed instead by the yarn presence sensor 4 so that the yarn presence sensor 22 can be deleted. In conjunction therewith, the movable arm member 20 can be replaced by a permanent guiding member 10''' which extends at an angle across the travel path of the tube stripping belt 10 for guiding the tube support members 1 from the tube stripping belt 10 onto the exit belt 12. Every tube support member 1 exiting the tube stripping device 18 would thus be guided by the permanent arm member 10''' onto the exit belt 12 so that both those tube support members 1 supporting the empty tubes 2 and those tube support members 1 supporting the tubes 2' which still have yarn remaining thereon following an unsuccessful yarn stripping operation would be returned to the transport belt 17. The yarn presence sensor 4 would then sense the presence of yarn on the tubes 2' and control the guiding of the respective tube support members 1 supporting these tubes 2' onto the entrance belt 6 for transport to the tube stripping device 18 for further yarn stripping operations thereat. It is conceivable that a particular tube 2' could be subjected to several yarn stripping operations at the tube stripping device 18 before the yarn remaining thereon is completely stripped from the tube.

In another modification of the embodiment of the tube handling apparatus 7 shown in FIG. 1, the entrance belt 6 and the belt 19 leading therefrom can be replaced by a single belt extending from the entrance end of the branch path to the yarn end preparation device or delivery assembly.

The present invention also contemplates that the tube handling apparatus 7 can be modified by replacing the movable arm member 9 that diverts tube support members to the tube stripping device 18 with a permanent arm member 9' which extends at an angle across the travel path of the entrance belt 6 for guiding tube support members 1 from the entrance belt 6 onto the tube stripping belt 10. The permanent arm member 9' would operate to guide both those tube support members 1 supporting the tubes 2' having less than the predetermined minimum recirculating amount of yarn thereon and those tube support members 1 supporting the tubes 2'' having more than the predetermined minimum recirculating amount of yarn thereon onto the tube stripping belt 10. The tube stripping device 18 would then operate to strip the yarn from all tubes 2' and 2'' that have any amount of yarn thereon.

Figure 2:
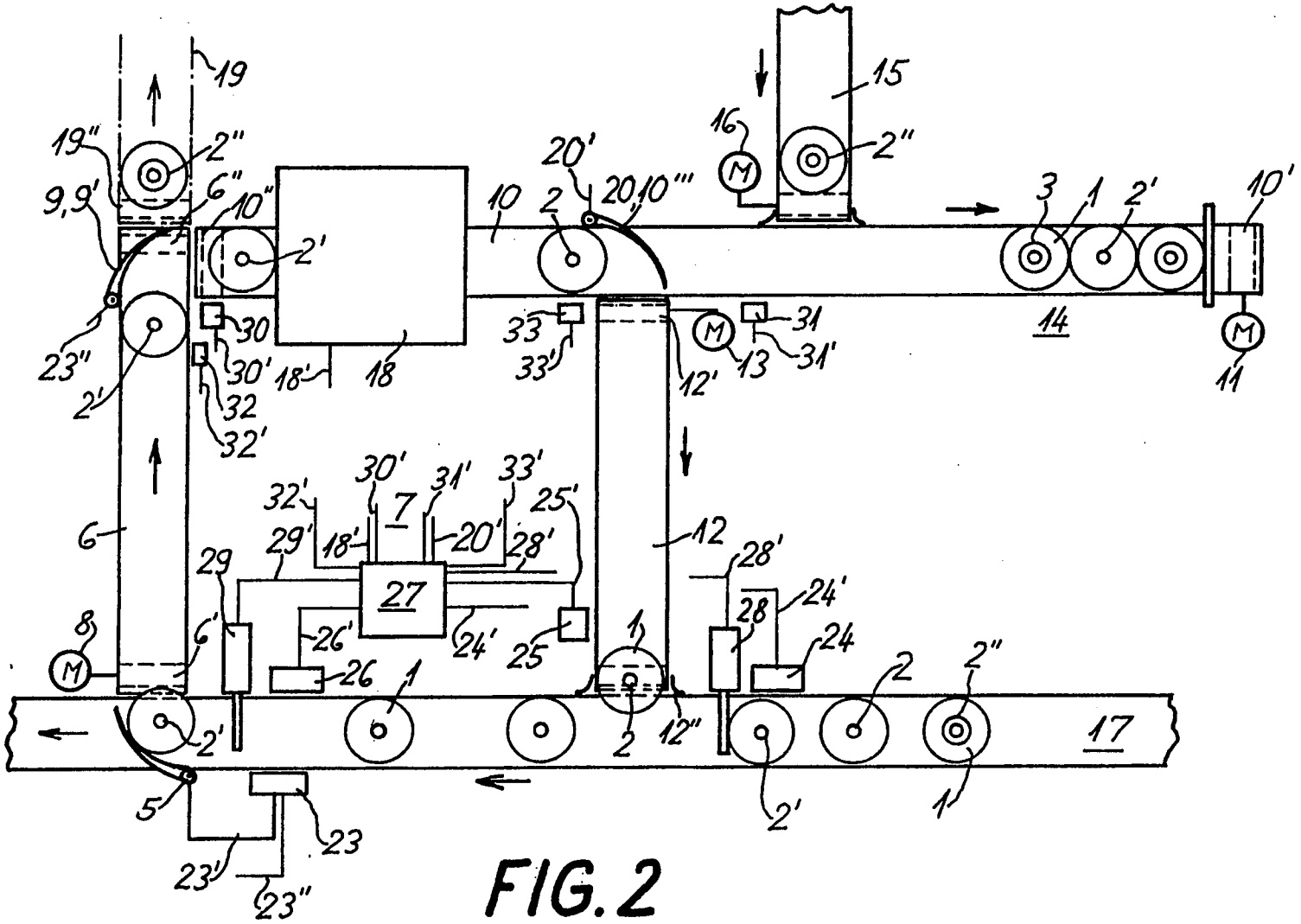
FIG. 2 is a plan view similar to FIG. 1 and showing another embodiment of the tube handling apparatus of the present invention.

In FIG. 2, another embodiment of the tube handling apparatus 7 of the present invention is illustrated. The embodiment of the tube handling apparatus 7 illustrated in FIG. 2 includes components identical to those of the embodiment of FIG. 1, except that the yarn presence sensor 4, the yarn amount sensor 21 and the yarn presence sensor 22 have been deleted and additional sensing means have been added in lieu thereof.

The tube handling apparatus 7 illustrated in FIG. 2 includes an entry sensing means 24 for sensing the presence of a tube support member 1 at an entry sensing location along the travel path of the discharge belt 17 upstream of the exit end of the branch path and downstream of the winding stations. The entry sensing means can be in the form of an entry sensor 24 configured as a conventional on-hand sensor operable to sense the presence of a tube support member 1 and/or the tube supported thereon during travel past the sensor. The entry sensor 24 is operatively connected via a connector 24' to a control unit 27. Reentry sensing means in the form of reentry sensor 25 configured as a conventional on-hand sensor is located relative to the travel path of the exit belt 12 for sensing the presence of a tube support member 1 at a reentry sensing location along the travel path of the exit belt 12 at a relatively short travel distance from the junction of the exit belt 12 and the discharge belt 17 at the exit end of the branch path. The reentry sensor 25 is operatively connected via a connector 25' to the control unit 27.

A primary sensing means in the form of a primary sensor 26 configured as a conventional on-hand sensor is provided for sensing the presence of a tube support member 1 at a primary sensing location along the travel path of the discharge belt 17 downstream of the junction of the discharge belt 17 and the exit belt 12 and upstream of the junction of the discharge belt 17 and the entrance belt 6. The primary sensor 26 is operatively connected via a connector 26' to the control unit 27.

A recirculating traffic sensing means in the form of a recirculating traffic sensor 32 configured as a conventional on-hand sensor is disposed adjacent the entrance belt 6 for sensing the presence of a tube support member 1 at a recirculating traffic sensing location along the travel path of the entrance belt 6 upstream of the movable arm member 9 that diverts tube support members to the tube stripping device, and is operatively connected via a connector 32' to the control unit 27. A post-stripping sensing means in the form of a post-stripping sensor 33 configured as a conventional on-hand sensor is positioned adjacent the tube stripping belt 10 for sensing the presence of a tube support member 1 at a post-stripping sensing location along the travel path of the tube stripping belt 10 downstream of the tube stripping device 18 and upstream of the movable arm member 20 that diverts tube support members to the exit belt 12. The post-stripping sensor 33 is operatively connected via a connector 33' to the control unit 27.

A storage traffic sensing means in the form of a storage traffic sensor 31 configured as a conventional on-hand sensor is disposed adjacent the travel path of the tube stripping belt 10 for sensing the presence of a tube support member 1 in a substantially stationary condition at a storage traffic sensing location downstream of the movable arm member 20 and upstream of the junction between the tube stripping belt 10 and the storage feed belt 15. The storage traffic sensor 31 is operatively connected via a connector 31' to the control unit 27.

A tube stripper traffic sensing means in the form of a tube stripper traffic sensor 30 configured as a conventional on-hand sensor is disposed along the travel path of the tube stripping belt 10 for sensing the presence of a tube support member 1 in a substantially stationary condition at a tube stripper traffic sensing location along the travel path of the tube stripping belt 10 upstream of the tube stripping device 18. The tube stripper traffic sensor 30 is operatively connected via a connector 30' to the control unit 27.

The discriminating means of the embodiment of the tube handling apparatus 7 shown in FIG. 2 includes a yarn sensor 23 operatively connected via a connector 23' to the movable arm member 5 that diverts tube support members from the discharge belt 17 and is operatively connected via a connector 23'' to the movable arm member 9 of the re-feed guiding means. The yarn sensor 23 is operable to discriminate among the empty tubes 2 having no yarn thereon, the tubes 2' having less than a predetermined minimum recirculating amount of yarn thereon, and the tubes 2'' having more than the predetermined minimum recirculating amount of yarn thereon and, in this regard, the yarn sensor 23 has the capability to distinguish between the tubes having no yarn (the tubes 2) and the tubes having yarn thereon (the tubes 2',2''), as well as the capability to distinguish between those tubes having less than a predetermined amount of yarn (the tubes 2') and the tubes having more than a predetermined amount of yarn (the tubes 2'').

An entry stop means in the form of an entry stop member 28 is disposed adjacent the travel path of the discharge belt 17 downstream of the entry sensor 24 and upstream of the junction between the discharge belt 17 and the exit belt 12 and includes an arm movable transversely across the travel path of the discharge belt 27 for selectively blocking further travel of the tube support members 1 beyond an entry location. The entry stop member 28 is operatively connected via a connector 28' to the control unit 27.

A primary stopping means in the form of a primary stopping member 29 is disposed adjacent the discharge belt 17 for selectively blocking further travel of the tube support members 1 beyond the sensing location at which the sensor 23 senses the tubes. The sensing location is downstream of the junction of the discharge belt 17 and the exit belt 12 and upstream of the junction of the discharge belt 17 and the entrance belt 6. The primary stopping member 29 is operatively connected via a connector 29' to the control unit 27.

The tube stripping device 18 is operatively connected via a connector 18' to the control unit 27.

The operation of the embodiment of the tube handling apparatus shown in FIG. 2 is as follows. The tube support members 1 transported on the discharge belt 17 are transported past the entry sensor 24 which signals the presence of each respective tube support member 1 at the entry sensing location via the connector 24' to the control unit 27, which maintains a count of the signals received from the entry sensor 24 for determining therefrom the number of tube support members 1 entering a loop formed by the branch path and the extent of the travel path of the discharge belt 17 between the exit and entrance ends of the branch path. The control unit 27 controls the entry stop member 28 to extend its arm at an angle across the travel path of the transport belt 17 based upon a determination by the control unit 27 that the number of signals received from the entry sensor 24 indicates that a predetermined number of tube support members 1 have traveled past the entry stop member 28. Accordingly, the subsequently following tube support members 1 which are upstream of the group comprised of the predetermined number of the tube support members 1 are prevented by the primary stop member 28 from traveling further along the travel path of the transport belts 17 into the loop.

The group of tube support members 1 continues to be transported by the transport belt 17 and are transported past the yarn sensor 23 for sensing thereby. Since the tube support members 1 transported along the transport belt 17 are randomly mixed with the possibility of some of the tube support members supporting an empty tube 2, others supporting a tube having less than the predetermined minimum recirculating amount of yarn 2' and still others having a tube 2'' having more than a predetermined minimum recirculating amount of yarn thereon, each group of the tube support members 1 which are transported past the yarn sensor 23 can be comprised of any number of combinations of tube support members supporting the three types of tubes 2, 2' and 2''.

The yarn sensor 23 controls the operation of the movable arm member 5 to guide those tube support members 1 supporting tubes 2' and 2'' having yarn thereon from the discharge belt 17 onto the entrance belt 6. On the other hand, the yarn sensor 23 controls the movable arm member 5 to remain in its clearance position to permit the transport therepast of those tube support members 1 having an empty tube 2 thereon for further transport to the further tube handling location.

The yarn sensor 23 also controls the operation of the movable arm member 9 to selectively guide each tube support member 1 supporting a tube 2' with less than a predetermined minimum amount of yarn thereon onto the tube stripping belt 10 and to permit the tube support members 1 supporting tubes 2'' with more than the predetermined amount of yarn thereon to travel beyond the entrance belt 6 onto the belt 19. In this regard, a conventional time delay means can be operatively connected to the yarn sensor 23 for delaying the guiding operation of the movable arm member 9 by a predetermined amount of delay time following the sensing by the yarn sensor 23 of a tube 2', 2'', with the predetermined amount of delay time corresponding to the amount of travel time required for the travel of the respective sensed tube 2', 2'' from the sensing location to the location for guiding by the movable arm member 9.

As the tube support members 1 travel on the entrance belt 6 past the recirculating traffic sensor 32, the recirculating traffic sensor 32 transmits a signal corresponding to each tube support member 1 traveling therepast to the control unit 27 by the connector 32'. The tube stripper traffic sensor 30 senses the travel of each of the tube support members supporting a tube 2' having less than the predetermined minimum amount of yarn thereon therepast and transmits a signal corresponding to each such tube support member via the connector 30' to the control unit 27.

The tubes 2' transported to the tube stripping device 18 are subjected to a yarn stripping operation and are thereafter transported downstream of the tube stripping device 18 past the post-stripping sensor 33, which transmits a signal corresponding to each tube support member traveling therepast via the connector 33' to the control unit 27. At this stage of the tube handling of the group of the tube support members 1, the control unit 27 controls the movable arm member 20 to remain in its diverting position for guiding the oncoming tube support members 1 from the tube stripping belt 10 onto the exit belt 12. Accordingly, each tube 2' which has been subjected to a yarn stripping operation at the tube stripping device 18, including those tubes which have been satisfactorily stripped of yarn, is thereafter guided along the exit belt 12 past the reentry sensor 25, which transmits a signal via the connector 25' to the control unit 27 corresponding to the presence of each tube support member 1 traveling therepast. The tube support members 1 are then returned to the discharge belt 17 and are transported thereby past the primary sensor 26, which senses each respective tube support member 1 traveling therepast and transmits a signal via the connector 26' to the control unit 27.

The control unit 27 is configured to control the operation of the movable arm member 20 associated with the storage location in correspondence with a determination by the control unit 27 relating to the number of trips of the tube support members 1 around the loop comprised of the branch path and the extent of the travel path of the discharge belt 17 between the exit and entrance ends of the branch path. Since the control unit 27 has received information from the yarn entry sensor 24 concerning the number of the tube support members comprising a group, the control unit 27 can evaluate the signals received from the respective sensors to determine the presence and number of the tube support members 1 of a group being transported within the loop. The operation of the control unit 27 can be illustrated with the following example. A group comprising ten of the tube support members 1 are entered past the primary stop member 28 into the loop. The control unit 27 follows the progress of these tube support members 1 through the loop by evaluating the information received from the respective sensors which sense the tube support members 1 as they travel therepast. If six of the tube support members 1 of the group support empty tubes 2, these six tube support members are transported out of the loop by the discharge belt 17 beyond the movable arm member 5 toward the further tube handling location. The remaining four tube support members 1 continue to travel in the loop.

To continue further with the example, if one of the remaining tube support members 1 supports a tube 2'' with more than the predetermined amount of yarn thereon, this tube support member 1 is transported out of the loop along the belt 19, as is schematically represented in FIG. 2 by the tube support member supporting a tube 2'' on the belt 19. The remaining three tube support members 1 continue to travel in the loop and are each subjected to a yarn stripping operation by the tube stripping device 18.

All of the remaining three of the tube support members 1 are sensed again by the yarn sensor 23 and those tube support members 1 which now support an empty tube 2 (the tube having been successfully completely stripped by the yarn stripping operation at the tube stripping device 18) are transported out of the loop through controlled operation of the movable arm member 5 by the yarn sensor 23 and the operation of the discharge belt 17. Those tube support members 1 still remaining in the loop are further transported around the loop and are subsequently delivered again to the tube stripping device 18. The control unit 27 can be configured to control the tube stripping device 18 to subject the remaining tube support members 1 to further yarn stripping operations. The control unit 27 can alternatively be configured to control the tube stripping device 18 to remain out of operation during the recirculation of the tube support members 1 therethrough so that the tube supported on these tube support members are not subjected to a further yarn stripping operation. In this regarded, the control unit 27 can additionally control the movable arm member 20 to move from its diverting position to its clearance position to permit transport of these tube support members 1 by the tube stripping belt 10 to the storage location 14, thereby effecting the transport of the remaining tube support members 1 out of the loop. A subsequent group of package support members 1 can then be allowed to enter the loop by withdrawal of the loop entry stop member 28 to repeat the above-described operation with a new group of tube support members.

If the control unit 27 controls the tube stripping device 18 to subject the tubes on the remaining tube support members 1 to further yarn stripping operations, the remaining tube support members continue to be circulated in the loop and those tube support members 1 that support tubes which have been successfully stripped in the subsequent yarn stripping operations are transported from the loop in correspondence with the sensing operation of the yarn sensor 23 and the operation of the movable arm member 5. After a predetermined number of circuits of the remaining tube support members 1 in the loop for subsequent yarn stripping operations, the control unit 27 operates the movable arm member 20 to permit the still remaining tube support members 1 to be transported by the tube stripping belt 10 into the storage location 14. Subsequent groups of the tube support members 1 can then be admitted to the loop in accordance with the controlled operation of the loop entry stop member 28 and the loop entry sensor 24.

The control unit 27 can also control the feed of the tube support members 1 to the tube stripping device 18 in response to a signal received from the tube stripper sensor 30. The sensor 30 has the capability to sense that a tube support member 1 is in a substantially stationary condition at the sensing location. For example, the sensor 30 can sense if the tube support member 1 has remained stationary during a predetermined unit of time.

The control unit 27 evaluates the signal from the sensor 30 as an indication that there is a sufficient number of tube support members disposed between the sensing location and the tube stripping device to prevent further travel of the sensed stationary tube support member. To prevent the accumulation of further tube support members 1 upstream of the sensed stationary tube support member 1, the control unit 27 can be configured to control the arm member 9 to move from its diverting position to its clearance position, thereby permitting the following tube support members to be transported onto the path 19 for further travel through the winding stations. Although these following tube support members may include tube support members supporting a tube 2' with less than the predetermined recirculating amount of yarn thereon, the release of the following tube support members onto the path 19 relieves the congestion of tube support members awaiting a yarn stripping operation. Those following tube support members which support a tube 2' that have been released in this manner will pass through the winding stations without further yarn unwinding operation and will ultimately be returned to the tube handling apparatus, which may be better able to handle these returned tube support members at the later time.

The control unit 27 can also control the bypass of the tube support members 1 if the storage location 14 is fully loaded. A storage traffic sensor 31 is operable to sense a tube support member 1 in a substantially stationary condition at a storage sensing location and the control unit 27 evaluates the signal received from the sensor 31 as an indication that there are a sufficient number of tube support members 1 at the storage location 14 to prevent further receipt of tube support members. The control unit 27 can be configured to respond to this signal by controlling the arm member 20 to remain in its diverting position for diverting the tube support members 1 from the tube stripping belt 10 onto the exit belt 12 so that all of the following tube support members (including those which support tubes which have not been satisfactorily stripped of yarn) continue to travel within the loop.

The primary stopping member 29 can be controlled by the control unit 27 to individually stop each tube support member 1 arriving at the sensing location at which the tube supported thereon is sensed by the yarn sensor 23. This individual stopping action increases the time at which a respective tube is supported at the sensing location and thereby correspondingly improves the conditions under which the yarn sensor 23 senses the tube. This longer sensing time is particularly advantageous if the respective tube has only a relatively very small amount of yarn remaining thereon.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile winding machine of the type having a plurality of winding stations at which yarn is unwound from yarn packages, a delivery assembly for transporting tube support members on which yarn packages are individually supported for transport to the winding stations, and a discharge assembly for transporting tube support members with tubes supported thereon from the winding stations, an apparatus for handling tubes received by the discharge assembly from the winding stations with yarn remaining thereon comprising:

branch path means defining a branch path for supporting tube support members for travel therealong having an entrance end operatively connected to the discharge assembly for the passage of tube support members from the discharge assembly to said branch path and an exit end operatively connected to the discharge assembly for the passage of tube support members from said branch path to the discharge assembly at a location upstream from said entrance end relative to the direction of transport of tube support members by the discharge assembly, the tube support members exiting said branch path through said exit end mixing with other tube support members being transported by the discharge assembly;

a tube stripping device disposed along said branch path for performing a yarn stripping operation on those tubes having remaining yarn thereon while the tubes are supported upright on the tube support members on said branch path;

discriminating means disposed along said discharge assembly for discriminating among tubes supported on tube support members being transported by the discharge assembly past a discriminating location upstream of said entrance end of said branch path and downstream of said exit end of said branch path, said discriminating means being operable to discriminate between empty tubes having no yarn thereon and tubes having remaining yarn thereon during the passage therepast of tubes supported both on tube support members which have not been previously handled by said tube stripping device and on tube support members which have previously been handled by said tube stripping device; and guiding means, operatively connected to said discriminating means, for guiding those tube support members supporting tubes having remaining yarn thereon from the discharge assembly to said branch path at said entrance end thereof in response to the identification of the tubes on such tube support members by said discriminating means.

2. In a textile winding machine, the apparatus according to claim 1 and characterized further by post-stripping sensing means disposed downstream of said tube stripping device relative to the direction of travel of the tube support members along said branch path for sensing the presence of yarn on a tube after the tube has been subjected to a yarn stripping operation by said tube stripping device, means defining a storage location extending from said branch path at a location thereon downstream of said tube stripping device, and storage guiding means, operatively connected to said post-stripping yarn sensing means, for guiding from said branch path to said storage location those respective tube support members supporting tubes having yarn remaining thereon following yarn stripping operations in response to sensing by said post-stripping sensing means of said respective tubes.

3. In a textile winding machine, the apparatus according to claim 1 and characterized further by post-stripping sensing means disposed at said tube stripping device for sensing the presence of yarn on a tube after the tube has been subjected to a yarn stripping operation by said tube stripping device, means defining a storage location extending from said branch path at a location thereon downstream of said tube stripping device, and storage guiding means, operatively connected to said post-stripping sensing means, for guiding from said branch path to said storage location those respective tube support members supporting tubes having yarn remaining thereon following yarn stripping operations in response to sensing by said post-stripping sensing means of said respective tubes.

4. In a textile winding machine, the apparatus according to claim 1 and characterized further in that said discriminating means is operable to discriminate among empty tubes having no yarn thereon, tubes having less than a predetermined minimum recirculating amount of yarn thereon and tubes having more than said predetermined minimum recirculating amount of yarn thereon and by re-feed path means extending from said branch path for transporting tube support members from said branch path to said delivery assembly for recirculation to said winding stations, and tube stripper guiding means, operatively connected to said discriminating means and disposed along said branch path upstream of said tube stripping device, said tube stripper guiding means guiding tube support members supporting tubes having less than said predetermined minimum recirculating amount of yarn thereon to said tube stripping means in response to sensing by said discriminating means and allowing tube support members supporting tubes having more than said predetermined minimum recirculating amount of yarn to pass to said re-feed path means.

5. In a textile winding machine, the apparatus according to claim 4 and characterized further by time delay means, operatively connected to said discriminating means and said tube stripper guiding means, for delaying the guiding operation of said tube stripper guiding means by a predetermined amount of delay time following the identification by said discriminating means of a tube having less than said predetermined recirculating amount of yarn, said predetermined amount of delay time corresponding to the amount of travel time required for the travel of the tube support member supporting the respective discriminated tube from the location at which the respective tube is identified by said discriminating means to the location for guiding of said tube support member by said tube stripper guiding means to said tube stripper.

6. In a textile winding machine, the apparatus according to claim 4 and characterized further by means downstream of said tube stripping device for sensing tubes that have not been satisfactorily stripped of yarn by said tube stripping device, means defining a storage location extending from said branch path downstream of said tube stripping sensing means, and storage guiding means for guiding from said branch path to said storage location the tube support members that support tubes sensed by said tube stripper sensing means that have not been satisfactorily stripped of yarn by said tube stripping device.

7. In a textile winding machine, the apparatus according to claim 1 and characterized further by secondary discriminating means disposed along said branch path upstream of said tube stripping device for discriminating among the tubes supported on those tube support members which have been guided onto said branch path, said secondary discriminating means being operable to discriminate between tubes having more than a predetermined minimum recirculating amount of yarn thereon and tubes having less than said predetermined minimum recirculating amount of yarn thereon, re-feed path means extending from said branch path downstream of said secondary discriminating means for transporting tube support members from said branch path to said delivery assembly for recirculation to said winding stations, and tube stripper guiding means operatively connected to said secondary discriminating means and disposed along said branch path downstream of said secondary discriminating means and upstream of said tube stripping device, said tube stripper guiding means guiding tube support members supporting tubes having less than said predetermined minimum recirculating amount of yarn thereon to said tube stripping means in response to sensing of the tubes by said secondary discriminating means and allowing tube support members supporting tubes having more than said predetermined minimum recirculating amount of yarn to pass to said re-feed path means.

8. In a textile winding machine, the apparatus according to claim 7 and characterized further by tube stripper guiding means, operatively connected to said discriminating means and disposed along said branch path upstream of said tube stripping device, for guiding tube support members supporting tubes having less than said predetermined minimum recirculating amount of yarn thereon to said tube stripping means in response to sensing of the tubes by said discriminating means and allowing tube support members supporting tubes having more than said predetermined minimum recirculating amount of yarn to pass to said re-feed path means, means defining a storage location extending from said branch path downstream of said tube stripping device, storage guiding means for guiding from said branch path to said storage location the tube support members that support tubes sensed by said tube stripper sensing means that have not been satisfactorily stripped of yarn by said tube stripping device, entry sensing means for sensing the presence of a tube support member at an entry sensing location on the discharge assembly upstream of said exit end of said branch path and downstream of the winding stations, re-entry sensing means for sensing the presence of a tube support member at a re-entry location along said branch path downstream of said storage guiding means and upstream of said exit end, and primary sensing means for sensing the presence of a tube support member at a primary sensing location along the discharge assembly downstream of said exit end of said branch path and upstream of said entrance end of said branch path.

9. In a textile winding machine, the apparatus according to claim 8 and characterized further by a control unit operatively connected to said entry sensing means and said reentry sensing means, entry stop means operatively connected to said control unit, for selectively blocking further travel of the tube support members beyond a stop location along the discharge assembly between said entry sensing location and said exit end of said branch path in response to a signal from said control unit, and stop means operatively connected to said primary sensing means and said control unit for selectively blocking further travel of tube support members beyond a stop location along the discharge assembly between said primary sensing location and said entrance end of said branch path in response to a signal from said control unit.

10. In a textile winding machine, the apparatus according to claim 9 and characterized further by recirculating traffic sensing means, operatively connected to said control unit, for sensing the presence of a tube support member at a recirculating traffic sensing location along said branch path upstream of said tube stripper guiding means, and post-stripping sensing means, operatively connected to said control unit, for sensing the presence of a tube support member at a sensing location along said branch path downstream of said tube stripping device and upstream of said storage guiding means, and said control unit is operable to receive signals from each of said sensing means indicating the presence of a tube support member at the location associated with the respective sensing means and to operate at least one of said stop means to selectively block further travel of tube support members beyond the respective stop location.

11. In a textile winding machine, the apparatus according to claim 10 and characterized further in that said control unit controls said storage guiding means to guide from said branch path to said storage location those tube support members that have been previously sensed by said reentry sensing means during their travel therepast.

12. In a textile winding machine, the apparatus according to claim 11 and characterized further in that said control unit controls said tube stripping device to permit the transport therethrough of a selected tube support member without performing a yarn stripping operation on the tube supported thereon in response to the evaluation by said control unit of signals received from said sensing means that indicate that the selected tube support member has previously passed through said tube stripping device without successful stripping of yarn from the tube supported thereon.

13. In a textile winding machine, the apparatus according to claim 10 and characterized further by a delivery path connected to said branch path downstream of said tube stopping device and tube stripper traffic sensing means, operatively connected to said control unit, for sensing the presence of a tube support member at a location along said branch path downstream of said tube stripper guiding means and upstream of said tube stripping device, said control unit controlling said tube stripper guiding means to guide each tube support member onto said delivery path in response to sensing by said tube stripper traffic sensing means of a tube support member in a substantially stationary condition at said tube stripper entry sensing location due to the presence of a sufficient number of tube support members disposed between said tube stripper entry sensing location and said tube stripping device to prevent further travel of the sensed stationary tube support member.

14. In a textile winding machine, the apparatus according to claim 13 and characterized further by outlet means, operatively connected to said delivery path and said control unit, for releasing tube support members from said branch path to the delivery assembly.

15. In a textile winding machine, the apparatus according to claim 10 and characterized further by a storage traffic sensing means, operatively connected to said control unit, for sensing the presence of a tube support member at a storage sensing location downstream of said storage guiding means.

16. In a textile winding machine, the apparatus according to claim 15 and characterized further in that said control unit controls said storage guiding means to permit tube support members to be further transported along said branch path beyond said storage guiding means in response to the sensing by said storage traffic sensing means of a tube support member held in a substantially stationary condition at said storage sensing location due to the presence of a sufficient number of tube support members disposed at said storage location to prevent further receipt of tube support members at said storage location.

17. In a textile winding machine, the apparatus according to claim 9 and characterized further in that said control unit is operatively connected to each of said guiding means for control of operation of said guiding means in response to sensing by at least one of said sensing means.

* * * * *